US008936205B2

(12) United States Patent
Dunn et al.

(10) Patent No.: US 8,936,205 B2
(45) Date of Patent: Jan. 20, 2015

(54) DUAL TRAJECTORY NOZZLE FOR ROTOR-TYPE SPRINKLER

(75) Inventors: Richard M. Dunn, Carlsbad, CA (US); Michael L. Clark, San Marcos, CA (US); Nathan T. Garcia, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 398 days.

(21) Appl. No.: 12/957,109

(22) Filed: Nov. 30, 2010

(65) Prior Publication Data

US 2012/0132727 A1 May 31, 2012

(51) Int. Cl.

| | |
|---|---|
| ***B05B 3/00*** | (2006.01) |
| ***B05B 3/04*** | (2006.01) |
| ***B05B 1/34*** | (2006.01) |
| ***B05B 15/06*** | (2006.01) |

(52) U.S. Cl.

CPC ..... *B05B 3/0431* (2013.01); *B05B 1/34* (2013.01); *B05B 3/045* (2013.01); *B05B 15/065* (2013.01)

USPC ..... 239/206; 239/394; 239/397

(58) Field of Classification Search

CPC .... B05B 3/0418; B05B 3/0422; B05B 3/0455

USPC ..... 239/237, 240, 246, 247, 587.1, 587.2, 239/587.5, 200–206, 391, 392, 394, 397, 239/442

See application file for complete search history.

(56) References Cited

U.S. PATENT DOCUMENTS 8,177,148 B1 5/2012 Renquist et al. ..... 239/587.1

OTHER PUBLICATIONS

Toro, DT35 and DT55 Series Rotary Sprinklers Installation & Service Instructions, 12 pages, 2007.

Toro, DT35/DT55 Series Golf Rotors, product brochure, 4 pages, 2009.

*Primary Examiner* — Christopher Kim

(74) *Attorney, Agent, or Firm* — Knobbe Martens Olson & Bear LLP

(57) ABSTRACT

A sprinkler includes a turbine, a gear drive, a nozzle turret, and a nozzle that is installed in the turret. The gear drive rotatably couples the turbine and the nozzle. The nozzle has an exit angle which is different from its entry angle to change the trajectory of the water as it passes through the nozzle. The nozzle can be installed in an orientation to increase the trajectory of the water leaving the sprinkler, or installed in an orientation to decrease the trajectory of the water leaving the sprinkler.

9 Claims, 9 Drawing Sheets

DUAL TRAJECTORY NOZZLE FOR ROTOR-TYPE SPRINKLER

FIELD OF THE INVENTION

The present invention relates to apparatus for irrigating turf and landscaping, and more particularly, to rotor-type sprinklers having a turbine that rotates a nozzle through a gear train reduction and a reversing mechanism with an adjustment for the arc of coverage.

BACKGROUND OF THE INVENTION

In many parts of the United States, rainfall is insufficient and/or too irregular to keep turf and landscaping green and therefore irrigation systems are installed. Such systems typically include a plurality of underground pipes connected to sprinklers and valves, the latter being controlled by an electronic irrigation controller. One of the most popular types of sprinklers to cover large areas of landscape is the pop-up rotor-type sprinkler. In this type of sprinkler a tubular riser is normally retracted into an outer cylindrical case by a coil spring. The case is buried in the ground and when pressurized water is fed to the sprinkler the riser extends telescopically in an upward direction. A turbine and a gear train reduction are mounted in the riser for rotating a nozzle turret at the top of the riser. The gear train reduction is sometimes encased in its own sub-housing which is referred to as a gear box. A reversing mechanism is also normally mounted in the riser along with an arc adjustment mechanism which is used to manually set the arc of coverage of the sprinkler nozzle.

The gear drive of a rotor-type sprinkler can include a series of staggered gears and shafts wherein a small gear on the top of the turbine shaft drives a large gear on the lower end of an adjacent second shaft. Another small gear on the top of the second shaft drives a large gear on the lower end of a third shaft, and so on. Alternately, the gear drive can comprise a planetary arrangement in which a central shaft carries a sun gear that simultaneously drives several planetary gears on rotating circular partitions or stages that transmit reduced speed rotary motion to a succession of similar rotating stages. It is common for the planetary gears of the stages to engage corresponding ring gears formed on the inner surface of the housing. See, for example, U.S. Pat. No. 5,662,545 granted to Zimmerman et al.

Rotor-type sprinklers can be designed to wet a full circle area around the sprinkler, or just part of a circle in which case an arc of pre-set angular dimension is covered by the stream of water ejected from the nozzle. Rotor-type sprinklers typically include at least one removable nozzle. Nozzles are typically available that change the amount of water being applied in terms of gallons per minute (GPM) and the radius or reach of the area being irrigated. The nozzle is installed into a cylindrical nozzle turret which is rotated at the top of the riser by the gear drive mechanism. The nozzle turret has at least one nozzle port where the nozzle is inserted. See for example U.S. Pat. No. 5,699,962 granted Dec. 23, 1997 to Loren W. Scott et al. and assigned to Hunter Industries, Inc. the assignee of the subject application. The nozzle port is typically inclined to cause the stream of water ejected from the nozzle to be sent upwards and outwards from the sprinkler. It is common for the port in the nozzle turret to be inclined at about twenty-five degrees relative to the surface of the surrounding landscape.

There are times when the sprinkler is installed in a landscape area where there is a hill in front of the sprinkler that may interfere with the stream of water spraying out of the sprinkler. It is common for an installer to install the sprinkler at an angle to the horizon to allow the sprinkler to shoot over the hill. This may require an additional sprinkler to irrigate the flat area in front of the hill. Other times, the sprinkler may be installed in an area with wind that carries the water off if it is emitted at too high of an angle. Manufactures often supply specially design low angle nozzles for this application that cause the stream to exit the sprinkler at a lower trajectory. A lower trajectory may also be required if low overhanging vegetation like tree limbs get in the way of a high trajectory and interfere with the irrigation process.

SUMMARY OF THE INVENTION

In accordance with the present invention, a nozzle can be inserted in one of two positions to either increase or decrease the trajectory of the stream of water leaving a sprinkler. The water leaves the nozzle at a different angle than when it enters the nozzle. The angle of the exit section of the nozzle is different from the entrance section of the nozzle.

DETAILED DESCRIPTION

Figure 1:
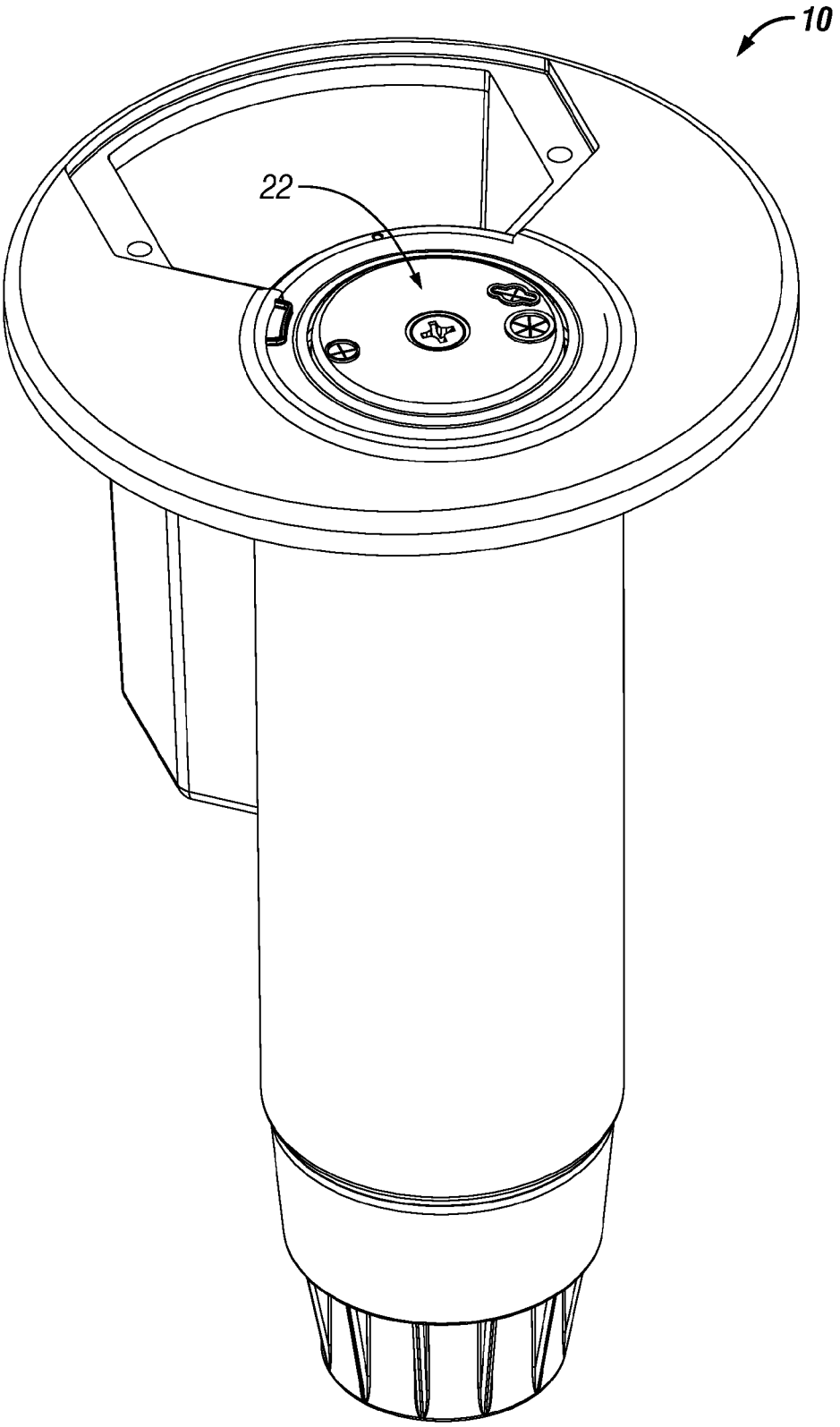
FIG. 1 Is an isometric view of a pop-up rotor-type sprinkler in accordance with an embodiment of the present invention viewed from its top side.
Figure 2:
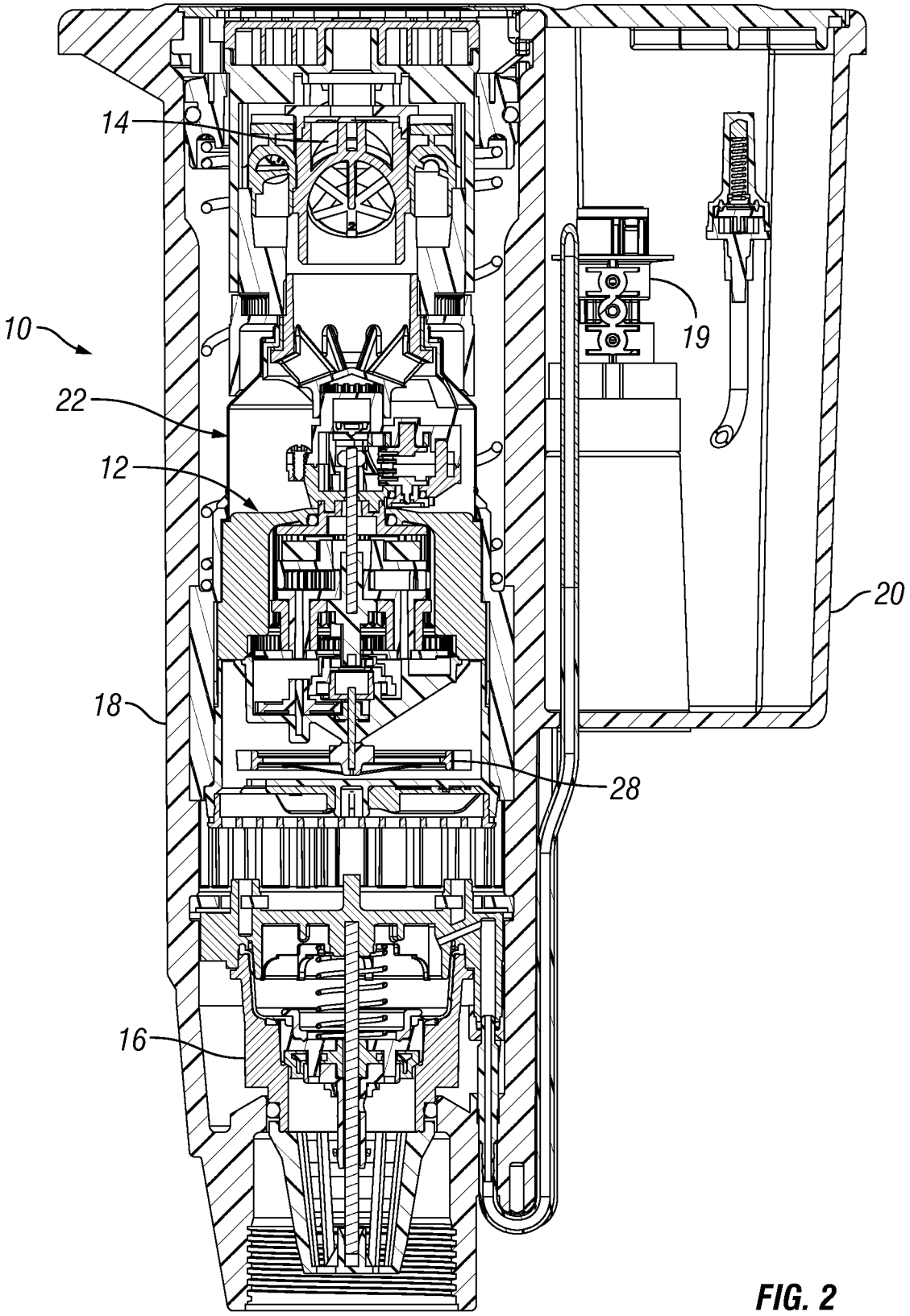
FIG. 2 is a vertical sectional view of the sprinkler of FIG. 1.

Referring to FIG. 1, in accordance with an embodiment of the present invention a rotor-type sprinkler 10 includes an outer housing 18 and a riser assembly 22. The sprinkler 10 incorporates a reversing planetary gear drive 12 (FIG. 2) that rotates or oscillates a nozzle 14 between pre-set arc limits. Except for the reversing planetary gear drive 12, and an additional reversing mechanism 13 (FIG. 3) located externally of the reversing planetary gear drive 12, the sprinkler 10 generally has a construction similar to that disclosed in U.S. Pat. No. 6,491,235 granted Dec. 10, 2002 to Lauren D, Scott et al. and assigned to Hunter Industries, Inc., the entire disclosure of which is hereby incorporated by reference. Except for the metal springs, the other components of the sprinkler 10 are generally made of injection molded plastic. The sprinkler 10 is a so-called valve-in-head sprinkler that incorporates a valve 16 in the bottom of a cylindrical outer case 18 which is opened and closed by valve actuator components 19 contained in a housing 20 on the side of the case 18. The sprinkler 10 includes a generally tubular riser 22. A coil spring 24 normally holds the riser 22 in a retracted position within the outer case 18. The nozzle 14 is carried inside a cylindrical nozzle turret 26 rotatably mounted at the upper end of the riser 22. The coil spring 24 is compressible to allow the riser 22 and nozzle turret 26 to telescope from their retracted positions to their extended positions when pressurized water is introduced into the female threaded inlet at the lower end of the outer case 18.

Figure 3:
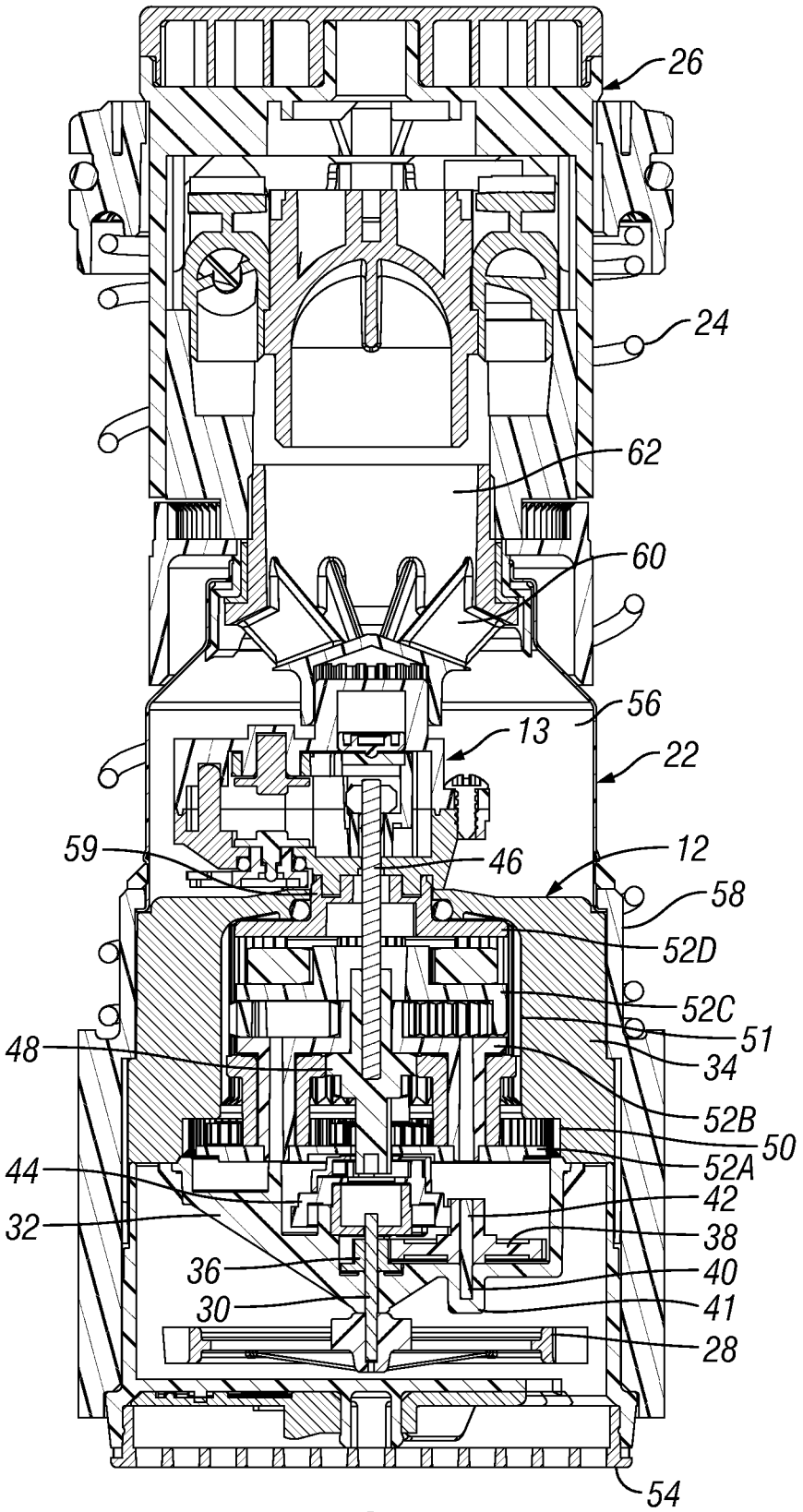
FIG. 3 is an enlarged vertical sectional view of the riser and nozzle turret of the sprinkler of FIG. 1.

FIG. 3 illustrates further details of the riser 22, nozzle turret 26 and reversing planetary gear drive 12. A turbine 28 is rigidly secured to the lower end of a vertically oriented drive input pinion shaft 30. The pinion shaft 30 extends through the lower cap 32 of a cylindrical gear box housing 34 of the reversing planetary gear drive 12. A turbine pinion gear 36 is rigidly secured to the upper end of the pinion shaft 30. The turbine pinion gear 36 drives a lower spur gear 38 secured to a spur gear shaft 40. The lower end of the spur gear shaft 40 is journaled in a sleeve 41 integrally formed in the lower cap 32. Another pinion gear 42 is integrally formed on top of the spur gear 38 and drives an upper spur gear 44 of the reversing planetary gear drive 12. Thus the turbine 28 is coupled to an input stage of the planetary gear drive 12.

Referring still to FIG. 3, the reversing planetary gear drive 12 has a centrally located main control shaft 46. The lower end of the control shaft 46 is rigidly and co-axially coupled to a bi-level shift sun gear 48 which is vertically reciprocated by axial movement of the control shaft 46 between a raised state illustrated in FIGS. 2 and 13 and a lowered state. The interior wall of the cylindrical gear box housing 34 is formed with two axially displaced ring gears 50 and 51. Each of the ring gears 50 and 51 comprises a plurality of circumferentially spaced, vertically extending, radially inwardly projecting teeth that are engaged by the various planet gears of the reversing planetary gear drive 12. The lower ring gear 50 has a larger diameter and more teeth than the upper ring gear 51. The upper ring gear 51 has a larger axial length than the lower ring gear 50. Together the ring gears 50 and 51 form a bi-level ring gear.

The reversing planetary gear drive has a construction similar to that disclosed in U.S. Pat. No. 7,677,469 granted Mar. 16, 2010 to Michael L. Clark and assigned to Hunter Industries, Inc., the entire disclosure of which is hereby incorporated by reference. Further details are disclosed in co-pending U.S. patent application Ser. No. 12/710,298 filed Feb. 22, 2010 in the names of Michael L. Clark et al. and entitled "Irrigation Sprinkler with Reversing Planetary Gear Drive Including Two Ring Gears with Different Profiles" and co-pending U.S. patent application Ser. No. 12/710,265 also filed Feb. 22, 2010 in the names of Michael L. Clark et al. entitled "Reversing Mechanism for an Irrigation Sprinkler With a Reversing Planetary Gear Drive", the entire disclosures of both which are hereby incorporated by reference.

The reversing planetary gear drive 12 further includes additional sun gears and planet gears. The other planet gears also engage the ring gears 50 and 51 and rotate about corresponding fixed cylindrical posts that extend vertically from their associated disc-shaped carriers 52A, 52B, 52C and 52D. Each non-shifting sun gear is rigidly secured to, or integrally formed with, one of the carriers 52B, 52C and 52D. The uppermost carrier 52D has an upwardly projecting central section 59 (FIG. 3) that is coupled to the underside of the reversing mechanism 13 in order to rotate the same. The reversing mechanism 13 in turn supports and rotates the nozzle turret 26. With this arrangement of gears the high RPM of the turbine 28 is successively reduced so that the final output RPM of the control shaft 46 is relatively low, and the output torque at the central section 59 of the uppermost carrier 52D is relatively high. For example, the turbine 28 may rotate at eight hundred RPM and the output shaft 46 may rotate at an RPM of less than one.

Figure 4:
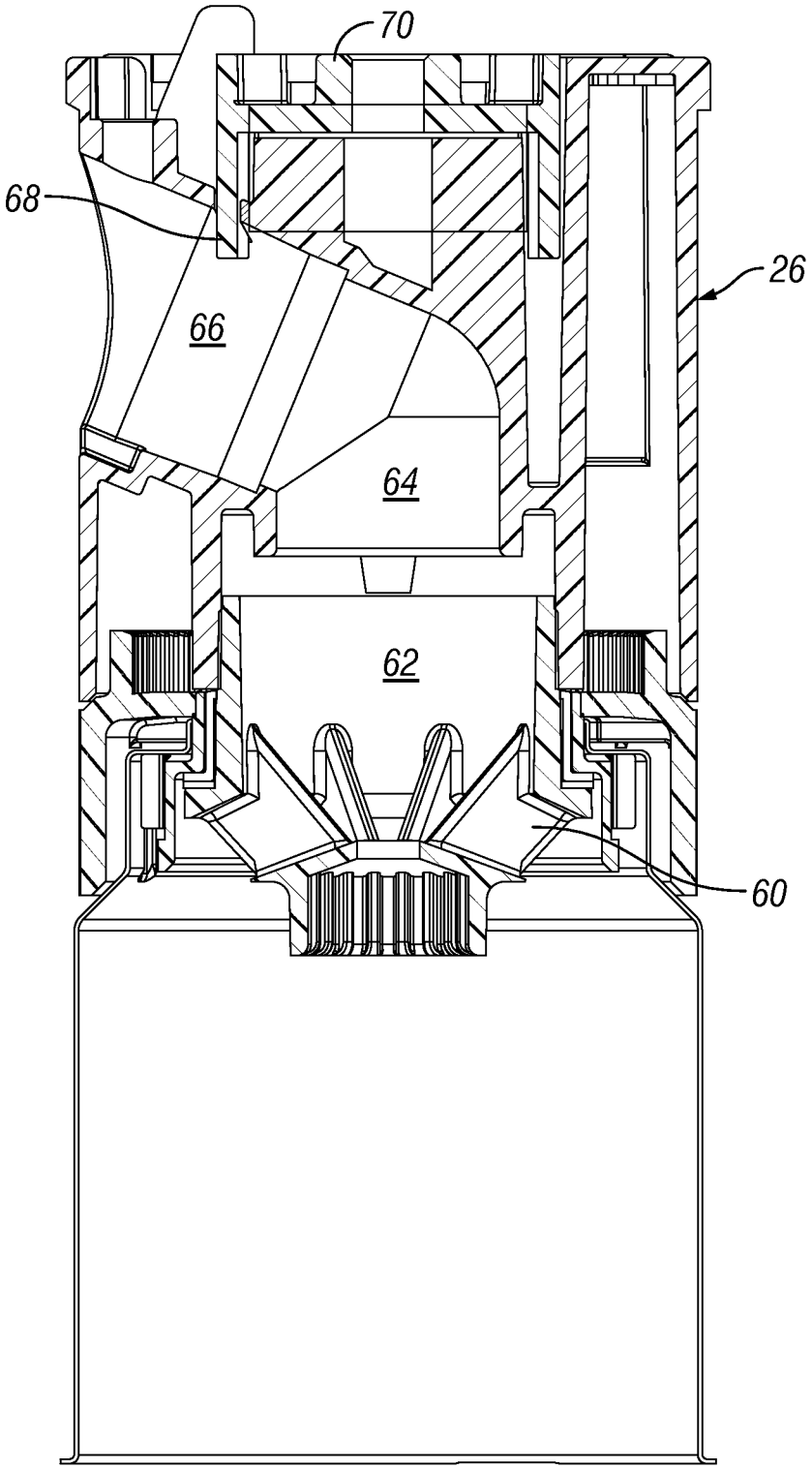
FIG. 4 is an enlarged vertical sectional view of the nozzle turret of the sprinkler of FIG. 1 rotated ninety degrees about its vertical axis relative to the orientation illustrated in FIG. 3.
Figure 5:
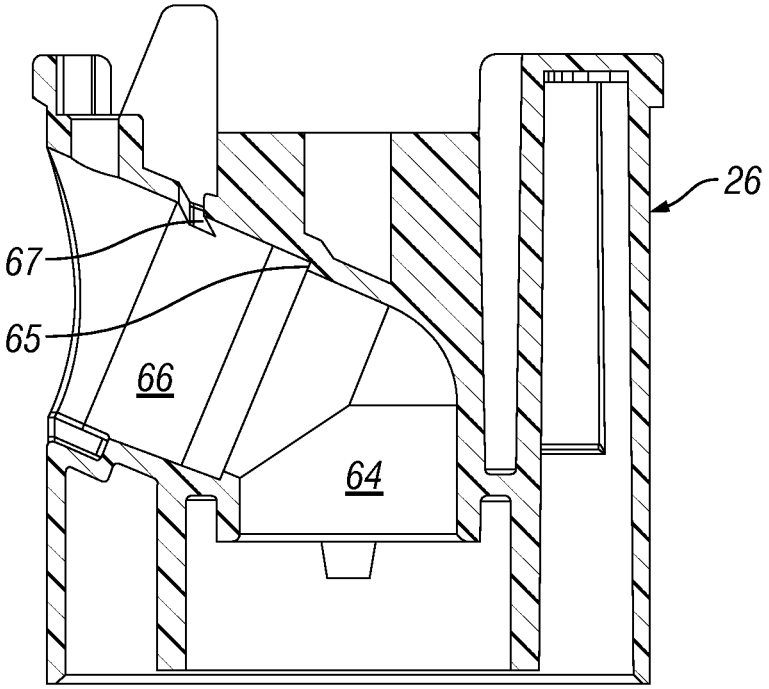
FIG. 5 is an enlarged portion of FIG. 4 illustrating further details of the nozzle turret of the sprinkler of FIG. 1 with the nozzle removed.

The fast spinning turbine 28 can slowly rotate the nozzle turret 26 through the reversing planetary gear drive 12 and the additional reversing mechanism 13. The gearbox housing 34 includes a plurality of circumferentially spaced fins (not illustrated) that support the gearbox housing 34 within the riser sleeve 58 and allow water to flow from the inlet screen 54, past the turbine 28 and then between the fins into chamber 56 (FIG. 3). Water then flows between a plurality of supporting fins 60 in into a chamber 62 and directly to a cylindrical nozzle turret primary port 64 (FIG. 4). FIG. 4 is rotated ninety degrees from the orientation in FIG. 3 for clarity. The nozzle turret primary port 64 leads to a cylindrical nozzle turret exit port 66 that is inclined at roughly a twenty degree angle relative to a plane intersecting the vertical axis of the nozzle turret primary port 64 in perpendicular fashion. A retainer tab 68 is attached to a secondary port holder 70. When the secondary part holder 70 is attached to the top of the turret 26, the retainer tab 68 protrudes through a slot 67 (FIG. 5) in the nozzle turret exit port 66 to retain the nozzle 14 in place for normal operation. Secondary port holder 70, including retainer tab 68 can be manually withdrawn from the nozzle turret 26 to permit removal or insertion of the nozzle 14 into the nozzle turret 26. Retainer tab 68 slides through the slot 67 and into a retainer cavity 72*a* or 72*b* (FIG. 10) to retain the nozzle 14 in its correct radial orientation and to prevent the nozzle 14 from coming out of the nozzle turret 26 during normal operation of the sprinkler 10.

Figure 6:
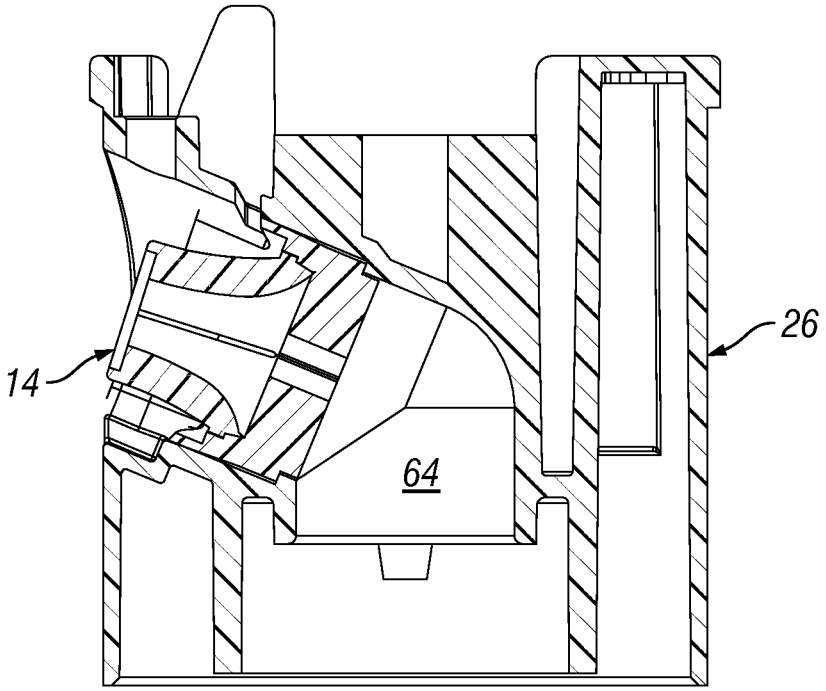
FIG. 6 is a view of the nozzle turret similar to FIG. 5 with the dual trajectory nozzle installed in its low trajectory orientation.
Figure 7:
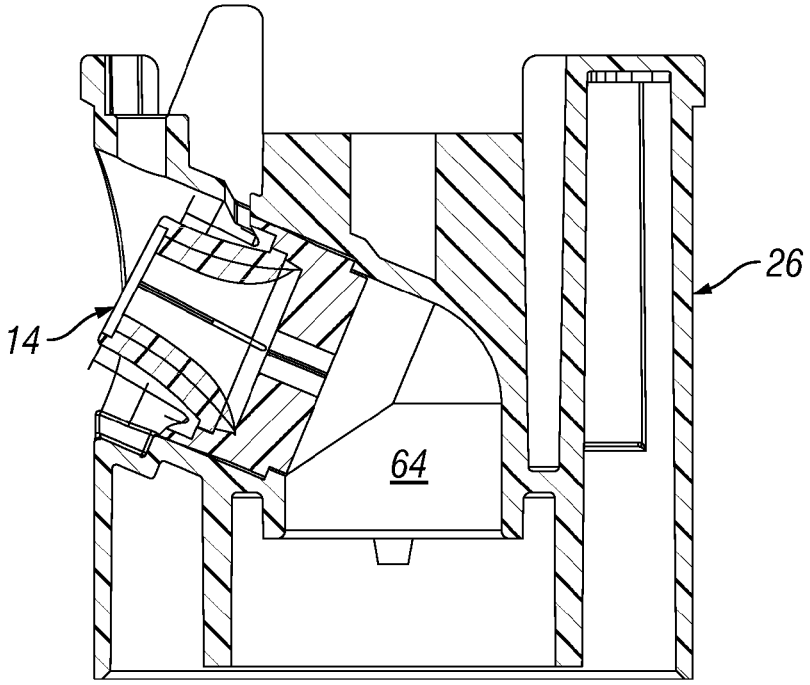
FIG. 7 is a view similar to FIG. 6 with the dual trajectory nozzle installed in its high trajectory orientation.

FIG. 6 illustrates the nozzle 14 installed into the nozzle turret 26 oriented for a low outlet trajectory as the outlet of nozzle 14 is at a lower angle than the exit port 66 of the nozzle turret 26. The central longitudinal axis of the nozzle 14 is orientated so the retainer cavity 72*a* is positioned at the top of the nozzle turret 26 where it is retained by the nozzle retainer tab 68. FIG. 7 illustrates the nozzle 14 installed in the nozzle turret 26 oriented for a high outlet trajectory as the outlet port 66 of the nozzle 14 is at a higher angle than the exit port of the nozzle turret. In this installation the central longitudinal axis of the nozzle 14 is orientated one hundred and eighty degrees from the orientation illustrated in FIG. 6 such that the ret retainer cavity 72*b* is at the top of the nozzle turret 26 where it is retained by the nozzle retainer tab 68.

Figure 8:
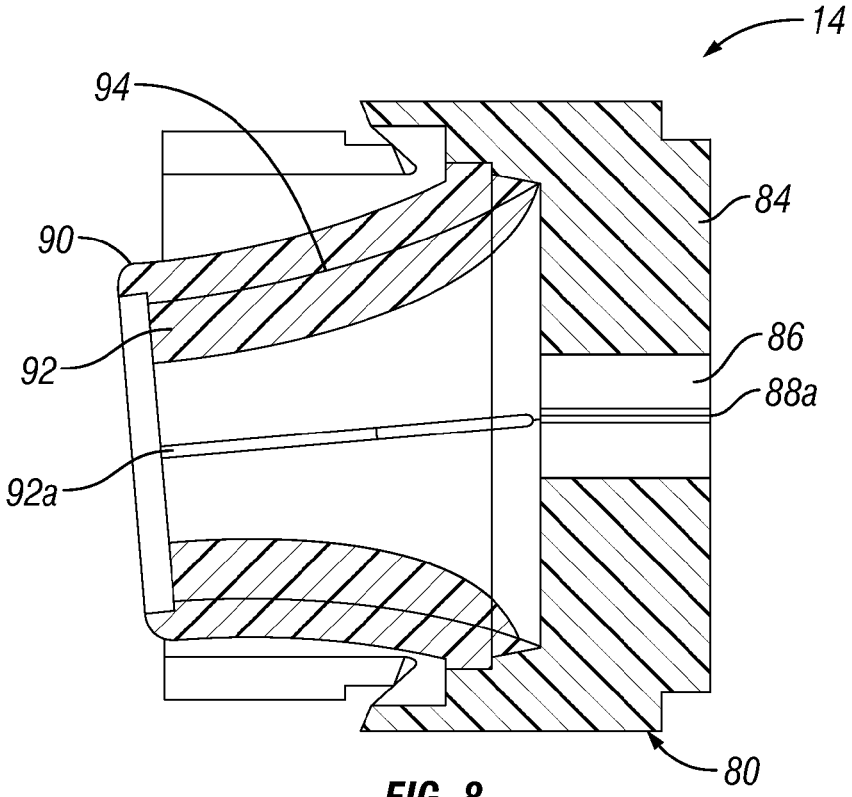
FIG. 8 is an enlarged sectional view of the dual trajectory nozzle illustrated in FIGS. 6 and 7 after it has been removed from the nozzle turret.
Figure 9:
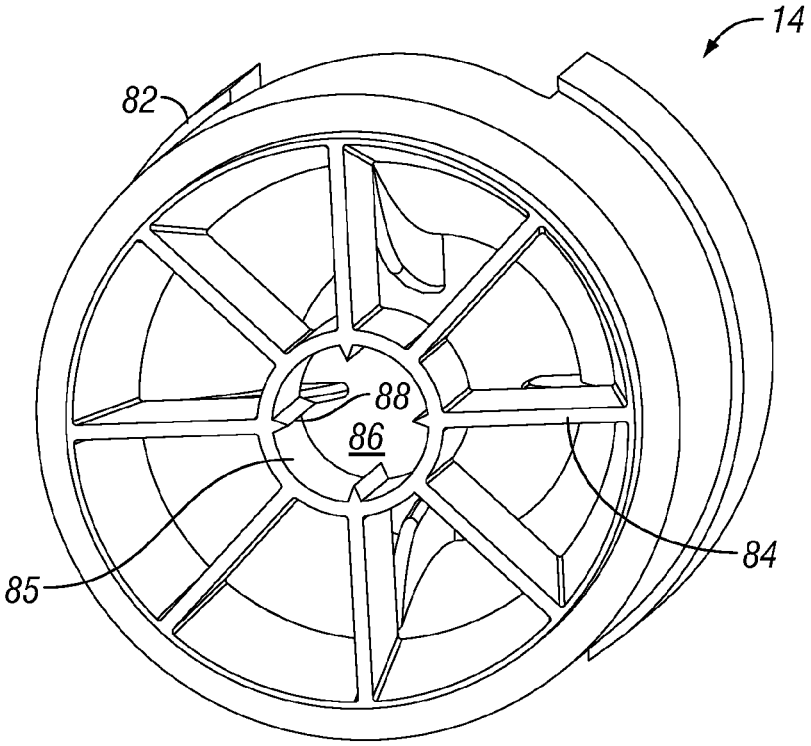
FIG. 9 is an enlarged isometric view of the inlet end of the dual trajectory nozzle illustrated in section in FIG. 8.
Figure 10:
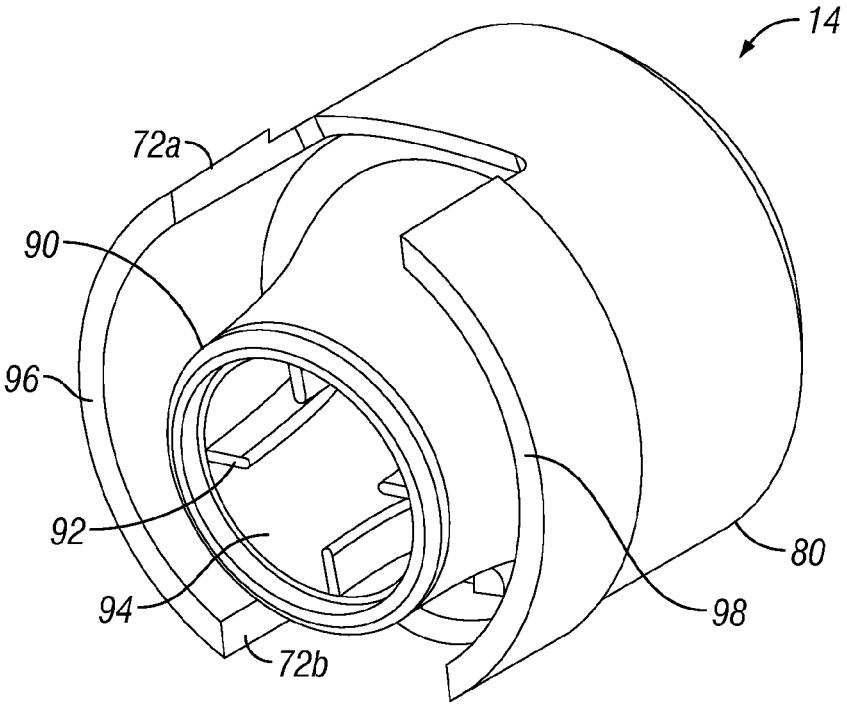
FIG. 10 is an enlarged isometric view of the outlet end of the dual trajectory nozzle illustrated in FIGS. 8 and 9.
Figure 11:
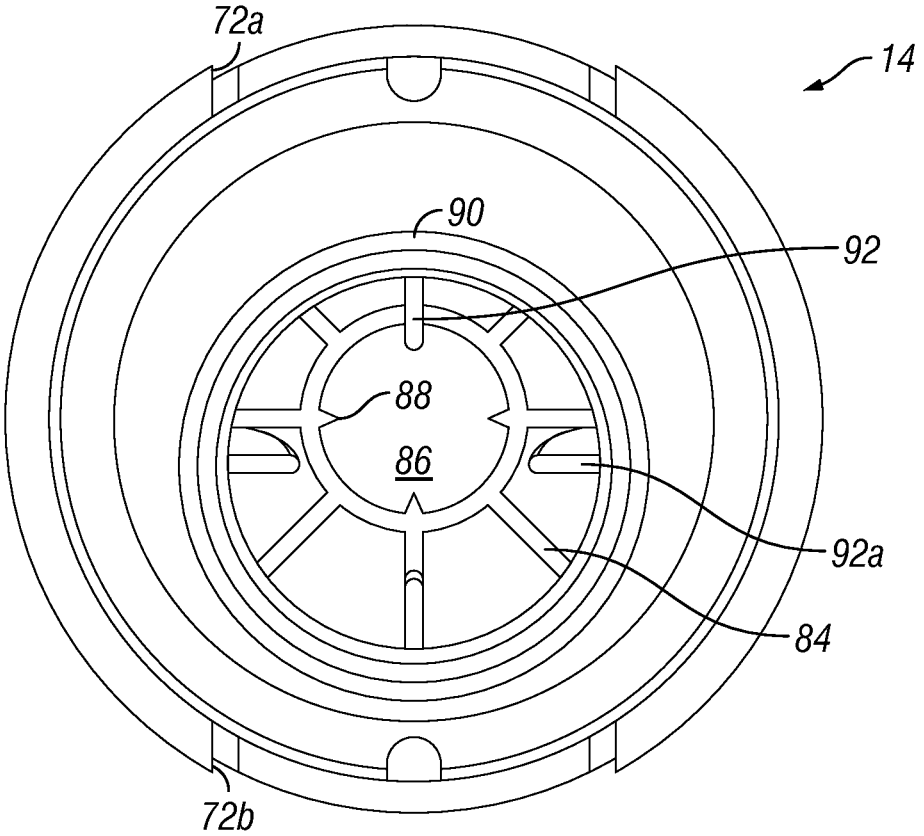
FIG. 11 is an enlarged front end view of the dual trajectory nozzle illustrated in FIGS. 8-10.

Referring to FIG. 8, the nozzle 14 has a generally cylindrical configuration and is comprised of two primary sections. The first section is provided by an inlet base 80 which includes a plurality of radially extending stream straightening fins 84 (FIG. 9), a ring-shaped member 85 defining a center port 86 and a plurality of V-shaped stream straightening tabs 88 formed on the inner wall of the ring-shaped member 85. These structures work together to reduce turbulence in the stream of water entering the nozzle 14. Removing the turbulence from the water is important to maximize the range that the water will reach after it leaves the nozzle 14. The second section of the nozzle 14 includes a tapered outlet spout 90 which includes a plurality of stream straightening fins 92 formed on an elliptical inner wall 94 of the tapered spout 90. The retainer cavities 72*a* and 72*b* are defined by a pair of axially aligned opposing semi-circular skirts 96 and 98 (FIG. 10). When the retainer tab 68 is not inserted in the slot 67, the cylindrical base 80 can be inserted in the exit port 64 of the nozzle turret 26 until a shoulder 82 (FIG. 8) on the rear end thereof engages a complementary shoulder 65 that forms the transition between the primary port 64 and the exit port 66 in the nozzle turret 26. Thus the exit port 66 functions as a socket for removably receiving the nozzle 14.

The combination of the elliptical inner wall 94 (FIG. 8) and the stream straightening fins 92 serves to keep turbulence to a minimum while changing direction of flow and accelerating the water prior to exiting the nozzle 14. The change of direction is most evident by observing the angular difference of the stream straightening fin 92*a* in FIG. 8 and the stream straightening tab 88*a*. The angular difference in this example is approximately five degrees. The outlet port 66 in the nozzle turret 26 may be manufactured at an exit angle of approximately twenty degrees, but the stream of water leaving nozzle spout 90 will be oriented so that it extends at an angle of approximately fifteen degrees relative to the surrounding ground if the retaining cavity 72*a* is upwardly oriented, or approximately twenty-five degrees if retaining cavity 72*b* is upwardly oriented. This allows a user to set the proper trajectory of the sprinkler 10 as required for the particular needs of the landscape being irrigated without having to choose from different nozzles. Turbulence in the delivery of water through a sprinkler significantly reduces the effectiveness of the sprinkler. The transition from vertical to twenty degree off horizontal is accomplished within the nozzle turret 26 between inlet chamber 64 and outlet port 66. It is important to maintain a smooth laminar flow of the water exiting the sprinkler 10. By having the inlet section of the nozzle 14 accept water directly in line with the flow the nozzle turret 26 causes the water to maintain its maximum velocity as it makes a smooth transition from the primary port 64 to the nozzle 14. Controlling the change of direction within the nozzle 14 to a higher or lower angle keeps the water flowing without excessive turbulence and produces a well controlled distribution of water out of the nozzle.

Figure 12:
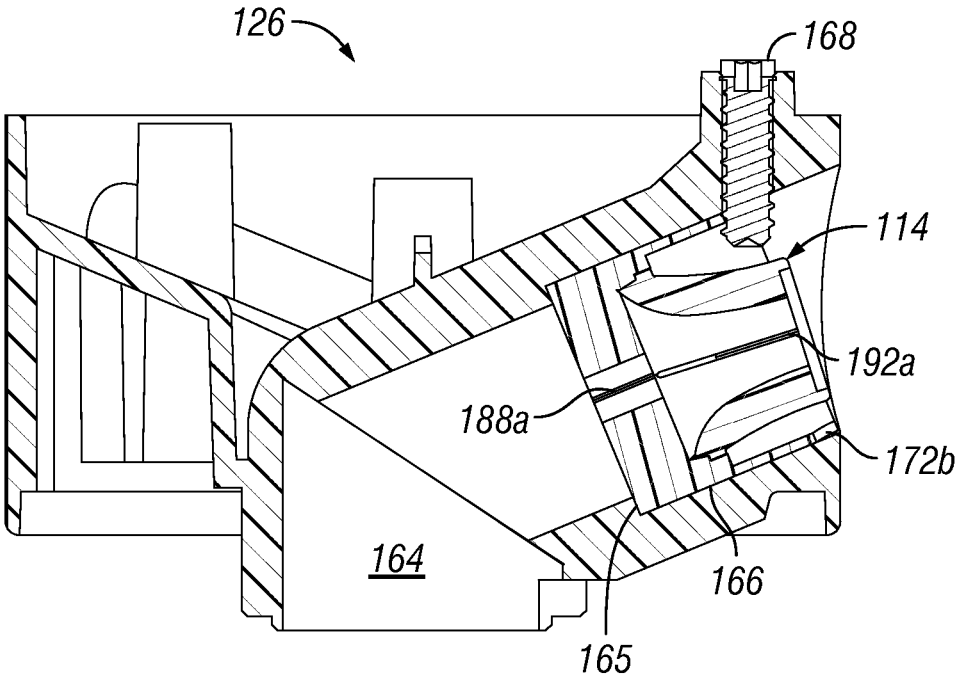
FIGS. 12 and 13 are sectional and isometric views of an alternate embodiment, respectively.

FIG. 12 illustrates an alternate embodiment of a nozzle 114 installed into an alternate nozzle turret 126 oriented for a low outlet trajectory. The outlet of the nozzle 114 is at a lower angle than the exit port 166 of the nozzle turret 126. The central longitudinal axis of the nozzle 114 is orientated so that the retainer cavity 172*a* (FIG. 13) is positioned at the top of the nozzle turret 126 where it is retained by a nozzle retainer screw 168. The primary difference in between the nozzle 114 and the nozzle 14 is that the outer cylindrical base 180 of the nozzle 114 is smooth to facilitate insertion into a smooth exit port 166 of the nozzle turret 126. In addition, the nozzle 114 incorporates the retention screw 168 to retain the nozzle 114 in position and smaller slots 172*a* and 172*b* to mate with the retention screw 166.

Figure 13:
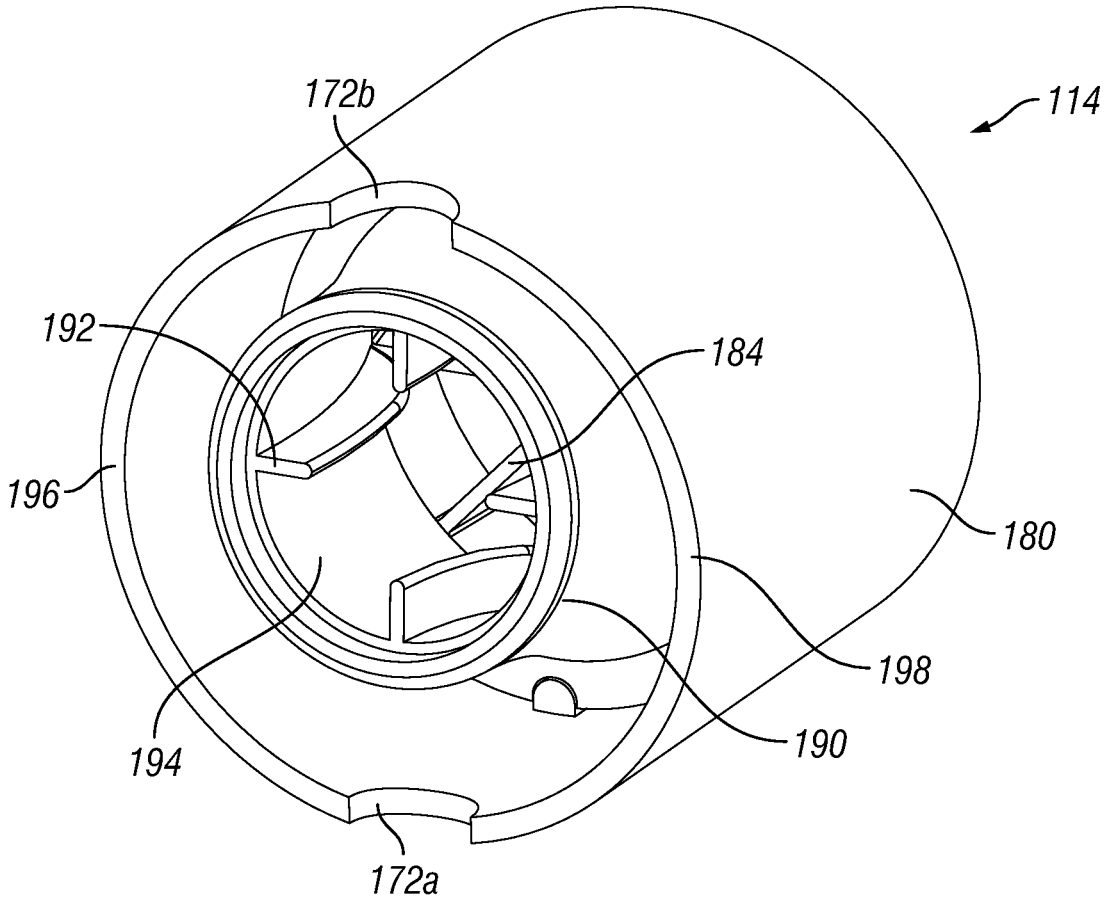

FIG. 13 illustrates the nozzle 114 oriented for a high outlet trajectory operation as the outlet port 194 of the nozzle 114 is at a higher angle than the central axis of its cylindrical base 180. In this figure, the retainer cavity 172*b* is located at the twelve o'clock position where it could be retained by the retention screw 168 if it were inserted into the nozzle turret 126 in this orientation.

Referring still to FIG. 13, the nozzle 114 has a generally cylindrical configuration and is comprised of two primary sections. The first section is provided by the smooth cylindrical inlet base 180 which includes a plurality of radially extending stream straightening fins 184, The nozzle 114 includes this same internal design as the nozzle 14 illustrated in FIG. 9. The retainer cavities 172*a* and 172*b* are defined by a pair of axially aligned opposing semi-circular skirts 196 and 198. When the retainer screw 168 is sufficiently unscrewed, the cylindrical base 180 can be inserted in the exit port 166 of the nozzle turret 126 until the rear end thereof engages a shoulder 165 (FIG. 12) that forms the transition between the primary port 164 and the exit port 166 in the nozzle turret 126. Thus the exit port 166 functions as a socket for removably receiving the nozzle 14. After insertion, the retaining screw 166 is simply turned until the lower segment of the screw 168 protrudes far enough into the exit port 166 to retain the nozzle 114.

As illustrated in the first embodiment, the combination of the elliptical inner wall 194 and the stream straightening fins 192 serves to keep turbulence to a minimum while changing direction of flow and accelerating the water prior to exiting the nozzle 114. The change of direction is most evident by observing the angular difference of the stream straightening fin 192*a* in FIG. 12 and the stream straightening tab 188*a*. The angular difference in this example is approximately five degrees. The exit port 166 in the nozzle turret 126 may be manufactured at an exit angle of approximately twenty degrees, but the stream of water leaving nozzle spout 90 will be oriented so that it extends at an angle of approximately fifteen degrees relative to the surrounding ground if the retaining cavity 172*a* is upwardly oriented, or approximately twenty-five degrees if retaining cavity 172*b* is upwardly oriented. This allows a user to set the proper trajectory of the sprinkler 10 as required for the particular needs of the landscape being irrigated without having to choose from different nozzles. It is important to maintain a smooth laminar flow of the water exiting the sprinkler 10. Controlling the change of direction within the nozzle 114 to a higher or lower angle keeps the water flowing without excessive turbulence and produces a well controlled distribution of water out of the nozzle.

While we have described and illustrated in detail several embodiments of a nozzle for a sprinkler that optimally changes the trajectory of the water leaving the nozzle, it should be understood that our invention can be modified in both arrangement and detail. For example, the sprinkler 10 could be modified to a simplified pop up or shrub configuration without the valve 16, outer case 18, valve actuator components 19 and housing 20. The nozzle turret 26 could be driven by any type of gear drive mechanism. The sprinkler may be designed to operate in a fixed arc of rotation, an adjustable arc of rotation, or a full circle rotation. The angle of the exit port 66 can be modified to be greater or less than twenty degrees relative to the horizontal. The angular change within the nozzle 14 can be greater or less than five degrees. The nozzle 14 may be constructed of one piece, or multiple pieces assembled together, to obtain the desired results. There may be more or fewer stream straightening fins 84 and 92 in the inlet or outlet sections. There may be stream straighteners only in the base, and not in the outlet, or in the outlet and not in the base, or no stream straighteners at all in the nozzle. The fins 84 in the inlet section may connect at the center and not require the center bore 86. There may be additional stream straightening members in the nozzle turret 26. The nozzle 14 may be retained in the nozzle turret 26 by a screw, clips, or other retention means. The retainer cavities 72*a* and 72*b* on the nozzle 14 may be larger or smaller or of a different shape to mate with a different retention device. There may be more than two retainer cavities to allow the nozzle to be inserted in more than two radial orientations. In one example, a third retainer cavity may exist ninety degrees from 72*a* and 72*b* to allow the sprinkler to work at fifteen, twenty, or twenty-five degree trajectories. The nozzle may be constructed with no retention cavities at all so the nozzle can be inserted in infinite number of positions to allow for an infinite trajectory adjustment between its uppermost and lowermost settings. The shape of the exterior base 80 may be of any design to mate with the outlet port 66 of nozzle turret 26. Therefore the protection afforded our invention should only be limited in accordance with the following claims.

We claim:

1. An irrigation sprinkler, comprising:

a riser;

a turbine;

a nozzle turret mounted at an upper end of the riser;

a drive assembly mounted in the riser and coupling the turbine and the nozzle turret so that pressurized water entering a lower end of the riser will cause the nozzle turret to rotate; and a nozzle configured for removable insertion into a socket in the nozzle turret, the nozzle having:

a base configured to be received by the socket in a first orientation and in a second orientation, the base defining a base flow channel having a base channel central axis oriented at a first axis angle from an axis of rotation of the nozzle turret; and a spout connected to the base, the spout having a spout flow channel having a spout channel central axis oriented at a second axis angle from the axis of rotation of the turret, the second axis angle being different from the first axis angle such that the base flow channel and the spout flow channel form a bent flow channel through the nozzle, the bent flow channel configured to generate a higher trajectory of a water stream ejected from the nozzle when inserted into the socket in the first orientation and a lower trajectory when inserted into the socket in the second orientation, the spout having a plurality of stream straightening fins and an elliptical inner wall.

2. The sprinkler of claim 1 wherein the nozzle turret has a vertically extending primary port that communicates with an exit port that extends at a predetermined angle relative to the primary port and provides the socket that receives the nozzle.

3. The sprinkler of claim 1 and further comprising a removable retainer that can be inserted through the nozzle turret to retain the nozzle in the socket.

4. The sprinkler of claim 3 wherein the nozzle includes a pair of retainer cavities for alternately receiving the retainer.

5. The sprinkler of claim 4 wherein the retainer is a screw.

6. The sprinkler of claim 1 wherein the base has a plurality of stream straightening fins.

7. The sprinkler of claim 6 wherein the plurality of stream straightening fins of the base extend radially and are connected to an outer side of a ring-shaped member having a center port, and a plurality of V-shaped stream straightening tabs extend from an inner wall of the ring-shaped member.

8. The sprinkler of claim 1, wherein the entire inner wall of the spout is elliptical.

9. An irrigation sprinkler comprising:

a riser having a longitudinal axis;

a turbine;

a nozzle turret mounted at an upper end of the riser, the nozzle turret having an inlet port and an outlet port, the inlet port having an inlet axis parallel to the longitudinal axis of the riser and having an inlet port wall parallel to the inlet axis, the outlet port having an outlet axis angled relative to the inlet axis and having an outlet port wall parallel to the outlet axis, the outlet port wall having a first end connected to the inlet port wall;

a drive assembly mounted in the riser and coupling the turbine and the nozzle turret so that rotation of the turbine will cause the nozzle turret to rotate; and a nozzle configured for removable insertion into a socket in the nozzle turret, the nozzle having:

a nozzle base;

a nozzle spout connected to the nozzle base; and a nozzle flow channel through the nozzle base and through the nozzle spout, the nozzle flow channel having an entrance port having an entrance axis parallel to a central axis of the nozzle base and an exit port having an exit axis parallel to a central axis of the nozzle spout, the nozzle flow channel having a bend between the entrance port and the exit port;

wherein, independent of the rotation of the nozzle turret, the outlet port is configured to receive the nozzle base in a first orientation and in a second orientation, wherein the exit axis is offset from the longitudinal axis of the riser by a first angle when the nozzle base is in the first orientation and the exit axis is offset from the longitudinal axis by a second angle different from the first angle when the nozzle base is in the second orientation, wherein in the first and second orientations the entire nozzle base is positioned at or downstream from the first end of the outlet port wall.

* * * * *